US012553618B2

(12) United States Patent
Zhi et al.

(10) Patent No.: US 12,553,618 B2
(45) Date of Patent: Feb. 17, 2026

(54) COOKING APPLIANCE

(71) Applicants: Guangdong Galanz Microwave Electrical Appliances Manufacturing Co., Ltd., Zhongshan (CN); Guangdong Galanz Enterprises Co., Ltd., Foshan (CN)

(72) Inventors: Xiujun Zhi, Zhongshan (CN); Feng Li, Zhongshan (CN); Zhouping Wang, Zhongshan (CN)

(73) Assignees: Guangdong Galanz Microwave Electrical Appliances Manufacturing Co., Ltd., Zhongshan (CN); Guangdong Galanz Enterprises Co., Ltd., Foshan (CN)

( * ) Notice: Subject to any disclaimer, the term of this patent is extended or adjusted under 35 U.S.C. 154(b) by 478 days.

(21) Appl. No.: 18/006,112

(22) PCT Filed: Nov. 16, 2022

(86) PCT No.: PCT/CN2022/132237

§ 371 (c)(1),
(2) Date: Jan. 19, 2023

(87) PCT Pub. No.: WO2024/092884

PCT Pub. Date: May 10, 2024

(65) Prior Publication Data

US 2024/0247810 A1 Jul. 25, 2024

(51) Int. Cl.

| | |
|---|---|
| ***F24C 15/20*** | (2006.01) |
| ***F24C 15/00*** | (2006.01) |
| ***F24C 15/32*** | (2006.01) |

(52) U.S. Cl.

CPC ..... *F24C 15/2007* (2013.01); *F24C 15/006* (2013.01); *F24C 15/325* (2013.01);
(Continued)

(58) Field of Classification Search

CPC ..... F24C 15/006; F24C 15/2007; F24C 15/325; F24C 15/32; F24C 15/322; F24C 15/001; F24C 15/20; F24C 15/2035
(Continued)

(56) References Cited

U.S. PATENT DOCUMENTS 4,332,992 A * 6/1982 Larsen ..... H05B 6/766 219/400
7,109,447 B2 * 9/2006 Goranson ..... A21B 1/245 219/501

(Continued)

FOREIGN PATENT DOCUMENTS

CN 108167879 A 6/2018
CN 210241668 U 4/2020

(Continued)

OTHER PUBLICATIONS

Written Opinion of the International Searching Authority dated Mar. 1, 2023.

*Primary Examiner* — Steven B McAllister
*Assistant Examiner* — Benjamin W Johnson
(74) *Attorney, Agent, or Firm* — Jacob M. Ward; Ward Law Office LLC

(57) ABSTRACT

The present application relates to the field of cooking equipment technologies, and specifically to a cooking appliance, including a box body, a door body, and a control panel case. The box body includes a housing, a cooking cavity located in the housing, and an electric chamber located on one side of the cooking cavity. The housing includes a top plate. An exhaust port is provided in the top plate. A first fan is disposed in the electric chamber. The door body and the control panel case are disposed on a front side of the cooking cavity. A cooling air inlet is provided in the door body and/or in the control panel case. The cooling air inlet, the electric chamber, the cooking cavity and the exhaust port are in fluid communication. The cooling air inlet is provided in the door
(Continued)

body and/or the control panel case, and the exhaust port is provided in the top plate of the housing. Compared with the prior art, an exhaust grille above the door body may be removed, so that the overall height of the cooking appliance can be reduced.

9 Claims, 6 Drawing Sheets

(52) U.S. Cl.
CPC ..... *F24C 15/001* (2013.01); *F24C 15/20* (2013.01); *F24C 15/2035* (2013.01); *F24C 15/32* (2013.01); *F24C 15/322* (2013.01)

(58) Field of Classification Search
USPC ..... 126/21 A
See application file for complete search history.

(56) References Cited

U.S. PATENT DOCUMENTS

| | | | | |
|---|---|---|---|---|
| 2002/0050492 | A1 | 5/2002 | Kim | |
| 2004/0134908 | A1 | 7/2004 | Jeong | |
| 2006/0175322 | A1 | 8/2006 | Beak et al. | |
| 2014/0322417 | A1* | 10/2014 | Kim | F24C 15/325 219/400 |
| 2022/0279631 | A1 | 9/2022 | Fan et al. | |
| 2022/0390120 | A1* | 12/2022 | Lee | F24C 7/082 |

FOREIGN PATENT DOCUMENTS

| | | | |
|---|---|---|---|
| CN | 112914347 | A | 6/2021 |
| CN | 112914348 | A | 6/2021 |
| CN | 112954840 | A | 6/2021 |

* cited by examiner

COOKING APPLIANCE

CROSS-REFERENCE TO RELATED APPLICATION

This application is a National Stage of International Application No. PCT/CN2022/132237, filed Nov. 16, 2022, which in turn claims priority to Chinese patent application No. 202222906455.2, entitled "COOKING APPLIANCE", filed with the China National Intellectual Property Administration on Nov. 1, 2022, the disclosure of which is hereby incorporated by reference in its entirety.

TECHNICAL FIELD

The present application relates to the field of cooking equipment technologies, and specifically to a cooking appliance.

BACKGROUND

A microwave cooking device with a fume extraction structure is usually referred to as an over the range (OTR) microwave oven. The OTR microwave oven with the functions of microwave heating and fume extraction is usually hung above a stove and usually higher than the top of a human head, and can extract fumes generated by the stove to prevent the fumes from causing pollution to a human body, which is equivalent to the function of a range hood.

In an existing OTR microwave oven, an exhaust grille is usually disposed above a door body. Fumes extracted from below the OTR microwave oven usually passes through two types of discharge channels. In one type of discharge channel, fumes are discharged through the exhaust grille above the door body into an indoor position higher than the position of a human head. This may be referred to as an internal circulation mode. In the other type of discharge channel, an opening is provided at the tail of a top cover of a box body of the OTR microwave oven, and a smoke exhaust pipe in communication with an outdoor environment is connected to the opening. Extracted fumes are discharged to the outdoor environment through the opening and the smoke exhaust pipe. This may be referred to as an external discharge mode.

Due to the installation of the exhaust grille above the door body, the overall height of the OTR microwave oven is equal to the overall height of the door body plus the exhaust grille, resulting in a relatively high overall height of the OTR microwave oven, which takes up more space, is not conducive to packaging, transportation, and installation, and is also more costly.

SUMMARY

Therefore, a technical problem to be resolved by the present application is to overcome the deficiency in the prior art that an OTR microwave oven has a relatively high overall height, and provide a cooking appliance that can reduce the overall height.

To solve the foregoing technical problem, a cooking appliance provided in the present application includes a box body, a door body, and a control panel case. The box body includes a housing, a cooking cavity located in the housing, and an electric chamber located on one side of the cooking cavity. The housing includes a top plate. An exhaust port is provided in the top plate. A first fan is disposed in the electric chamber. The door body and the control panel case are disposed on a front side of the cooking cavity. A cooling air inlet is provided in the door body and/or in the control panel case. The cooling air inlet, the electric chamber, the cooking cavity and the exhaust port are in fluid communication.

Optionally, a cavity air inlet hole is provided in a cavity wall of the cooking cavity adjacent to the electric chamber, and the electric chamber is in fluid communication with the cooking cavity through the cavity air inlet hole.

Optionally, a cavity exhaust hole is provided in a top wall of the cooking cavity, an air director is disposed above the cavity exhaust hole, and the air director is in communication with the exhaust port.

Optionally, the housing includes a bottom plate, a smoke inlet is provided in the bottom plate, a second fan is disposed behind the electric chamber, a third fan is disposed on the other side of the cooking cavity, the smoke inlet extends from a position under the second fan to a position under the third fan, and an air outlet of the second fan and an air outlet of the third fan are respectively in fluid communication with the exhaust port.

Optionally, an installation board is further disposed in the electric chamber, the installation board is located above the first fan, a filter plate is disposed on the installation board, and a space above the installation board is in fluid communication with the cooling air inlet, an air suction opening of the second fan and the exhaust port.

Optionally, a magnetron and a first partition board are disposed in the electric chamber, the first partition board is disposed between the cooking cavity and the housing and extends in a vertical direction, a connection between the first partition board and the cooking cavity is located on a side of the second fan close to the cavity air inlet hole, and the magnetron is located on an air supply path of the first fan.

Optionally, the exhaust port includes a first exhaust port and a second exhaust port distributed in a left-and-right direction, a second partition board and a third partition board extending in a front-and-rear direction are disposed on the top wall of the cooking cavity, the second partition board is adjacent to the installation board, the third partition board and the second partition board are spaced apart, a region between the second partition board and the third partition board is in communication with the second exhaust port, the air director is located on a side of the third partition board away from the second partition board, the first exhaust port is in communication with the air outlet of the third fan and the air director, a fourth partition board is further disposed on a rear side of the cooking cavity, and the fourth partition board is disposed to extend in a vertical direction between the cooking cavity and the housing and is connected to the third partition board.

Optionally, a fifth partition board is further disposed on the rear side of the cooking cavity, the fifth partition board is disposed obliquely, a lower end of the fifth partition board is disposed adjacent to the air outlet of the second fan, and an upper end of the fifth partition board is connected to the fourth partition board and is close to the top wall of the cooking cavity.

Optionally, the housing includes a bottom plate, a smoke inlet is provided in the bottom plate, a third fan is further disposed between the cooking cavity and the housing, the third fan and the electric chamber are respectively located on a left side and a right side of the cooking cavity, an air inlet of the third fan is in communication with the smoke inlet, and an air outlet of the third fan is provided adjacent to the exhaust port.

Optionally, the smoke inlet includes a first smoke suction opening and a second smoke suction opening, the first smoke suction opening and the second smoke suction opening are respectively located on a left side and a right side of the bottom plate, the housing includes a rear plate, a rear air duct is formed between the rear plate and the cooking cavity, the first smoke suction opening is adjacent to the air inlet of the third fan and is in communication with the air inlet of the third fan, and the second smoke suction opening is in communication with the air inlet of the third fan through the rear air duct.

The technical solution in the present application has the following advantages:

In the cooking appliance provided in the present application, cooling air is extracted by the first fan to enter the electric chamber through the cooling air inlet in the door body and/or in the control panel case to implement heat dissipation and temperature reduction for the door body, the control panel case, and the electric chamber, then enters the cooking cavity to perform cooling and temperature reduction in the cooking cavity, and is then discharged through the exhaust port. Steam generated inside the cooking cavity during normal operation of the cooking appliance can also be discharged through the exhaust port. The cooling air inlet is provided in the door body and/or the control panel case, and the exhaust port is provided in the top plate of the housing. Compared with the prior art, an exhaust grille above the door body may be removed, so that the overall height of the cooking appliance can be reduced.

BRIEF DESCRIPTION OF THE DRAWING

To describe the technical solutions in specific embodiments of the present application or the prior art more clearly, the following briefly introduces the accompanying drawings required for describing the specific embodiments or the prior art. Apparently, the accompanying drawings in the following description show some embodiments of the present application, and a person of ordinary skill in the art may still derive other drawings from these accompanying drawings without creative efforts.

REFERENCE NUMERALS

Figure 1:
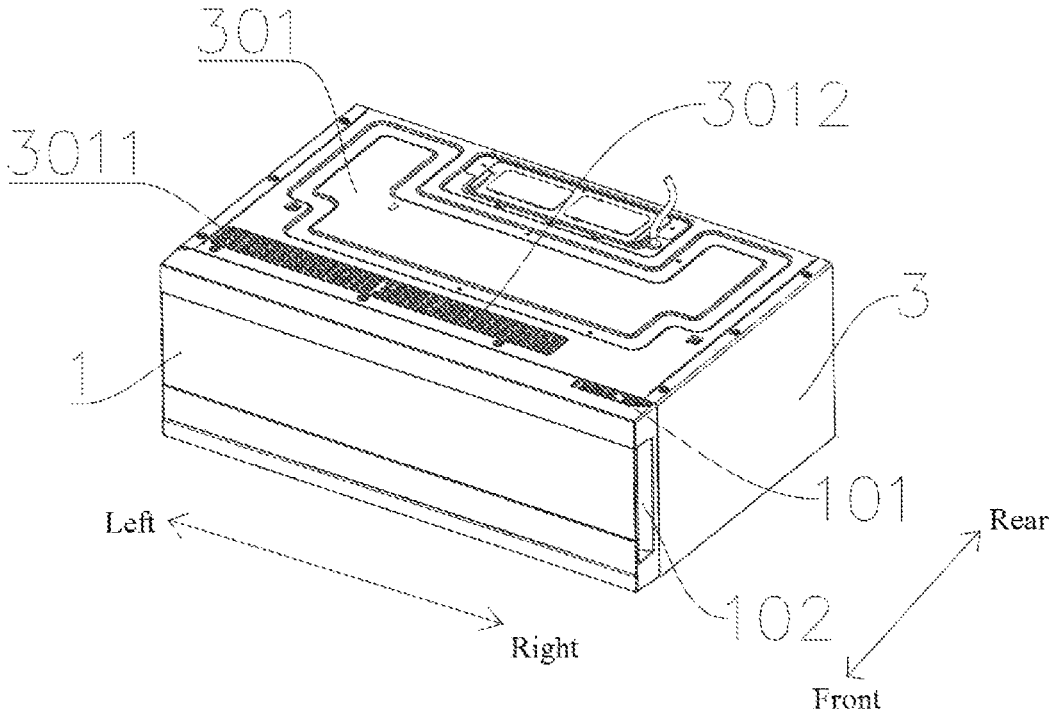
FIG. 1 is a schematic structural diagram of a cooking appliance according to Embodiment 1 of the present application from an angle.
Figure 2:
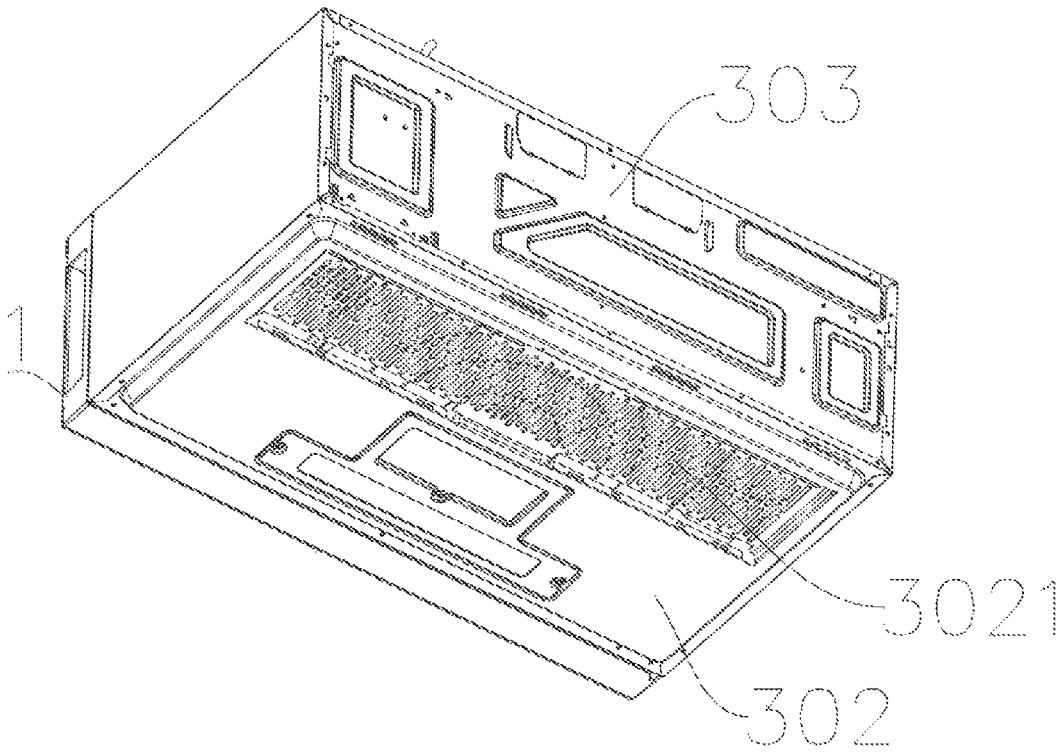
FIG. 2 is a schematic structural diagram of a cooking appliance according to Embodiment 1 of the present application from another angle.

1, door body; 101, cooling air inlet; 102, door handle; 2, control panel case; 3, housing; 301, top plate; 3011, first exhaust port; 3012, second exhaust port; 302, bottom plate; 3021, smoke inlet; 303, rear plate; 4, cooking cavity; 401, cavity air inlet hole; 402, cavity exhaust hole; 403, rear wall; 404, top wall; 405, cavity front plate; 4051, opening; 5, electric chamber; 6, first fan; 7, air director; 701, air guide opening; 8, second fan; 9, third fan; 10, installation board; 1001, wind mesh; 11, magnetron; 12, first partition board; 13, second partition board; 14, third partition board; 15, fourth partition board; 16, fifth partition board; 17, sixth partition board; 1701, smoke opening; 30200, first smoke suction opening; 30201, second smoke suction opening; 20, rear air duct; 21, cover plate; 22, support partition board; and 2201, circulation hole.

DETAILED DESCRIPTION

The following clearly and completely describes the technical solutions in the present application with reference to the accompanying drawings. Apparently, the described embodiments are some rather than all of the embodiments of the present application. All other embodiments obtained by persons of ordinary skill in the art based on the embodiments of the present application without creative efforts shall fall within the protection scope of the present application.

In the description of the present application, it needs to be understood that orientation or location relationships indicated by terms "center", "up", "down", "left", "right", "vertical", "horizontal", "inside", and "outside" are based on orientation or location relationships shown in the accompanying drawings, and are only used to facilitate description of the present application and simplify description, but are not used to indicate or imply that the apparatuses or elements must have specific orientations or are constructed and operated by using specific orientations, and therefore, cannot be understood as a limit to the present application. In addition, the terms "first", "second", and "third" are used only for description, but are not intended to indicate or imply relative importance.

In the description of the present application, it needs to be noted that unless otherwise expressly specified and defined, "mounted", "connected", and "connection", should be understood in a broad sense, for example, fixedly connected, detachably connected or integrally connected; or mechanically connected or electrically connected; or connected directly or indirectly through an intermediate, or two elements communicated internally. For a person of ordinary skill in the art, specific meanings of the terms in the present application should be understood according to specific conditions.

In addition, the technical features involved in different embodiments of the present application described below can be combined with each other as long as they do not constitute a conflict between them.

Example 1

In an existing OTR microwave oven, due to the installation of the exhaust grille above the door body, the overall height of the OTR microwave oven is equal to the overall height of the door body plus the exhaust grille, resulting in a relatively high overall height of the OTR microwave oven, which takes up more space, is not conducive to packaging, transportation, and installation, and is also more costly.

For this, this embodiment provides a cooking appliance. The overall height of the cooking appliance can be reduced, which can be conducive to packaging, transportation, and installation, and can reduce costs. The cooking appliance may be specifically a microwave oven, a halogen oven, a toaster oven, or the like.

In an implementation, as shown in FIG. 1 to FIG. 6, the cooking appliance includes a box body, a door body 1, and a control panel case 2. The box body includes a housing 3, a cooking cavity 4 located in the housing 3, and an electric chamber 5 located on one side of the cooking cavity 4. The housing 3 includes a top plate 301. An exhaust port is provided in the top plate 301. A first fan 6 is disposed in the electric chamber 5. The door body 1 and the control panel case 2 are disposed on a front side of the cooking cavity 4. A cooling air inlet 101 is provided in the door body 1 and/or in the control panel case 2. The cooling air inlet 101, the electric chamber 5, the cooking cavity 4 and the exhaust port are in fluid communication.

In this implementation, cooling air is extracted by the first fan 6 to enter the electric chamber 5 through the cooling air inlet 101 in the door body 1 and/or in the control panel case 2 to implement heat dissipation and temperature reduction for the door body 1, the control panel case 2, and the electric chamber 5, then enters the cooking cavity 4 to perform cooling and temperature reduction in the cooking cavity 4, and is then discharged through the exhaust port. Steam generated inside the cooking cavity 4 during normal operation of the cooking appliance can also be discharged through the exhaust port. The cooling air inlet 101 is provided in the door body 1 and/or the control panel case 2, and the exhaust port is provided in the top plate 301 of the housing 3. Compared with the prior art, an exhaust grille above the door body 1 may be removed, so that the overall height of the cooking appliance can be reduced.

With reference to FIG. 1, during actual operation of the cooking appliance, the left side of a human body when the human body faces the cooking appliance is the left side of the cooking cavity 4, and the right side of the human body when the human body faces the cooking appliance is the right side of the cooking cavity 4. A side on which the door body 1 is located is the front side, and a side opposite to the door body 1 is the rear side. In a specific implementation, as shown in FIG. 3 and FIG. 4, the electric chamber 5 is located on the right side of the cooking cavity 4.

Figure 3:
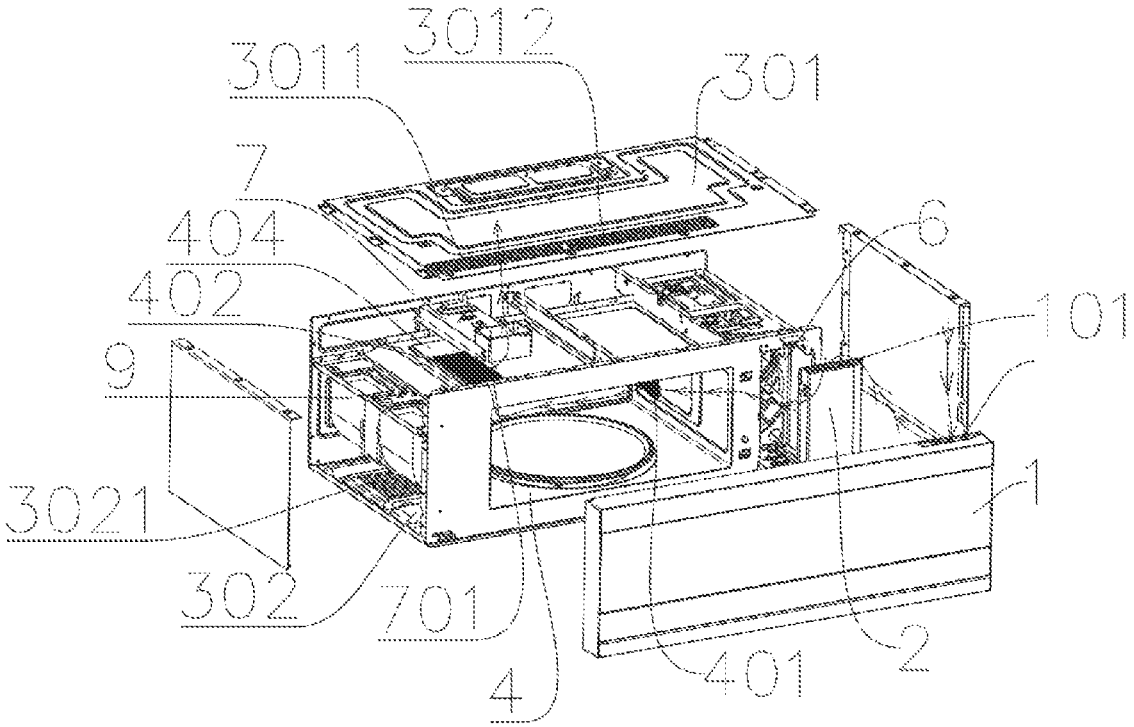
FIG. 3 is a schematic structural diagram of a housing, a door body, and a control panel case of a cooking appliance being separated from a cooking cavity from an angle.
Figure 4:
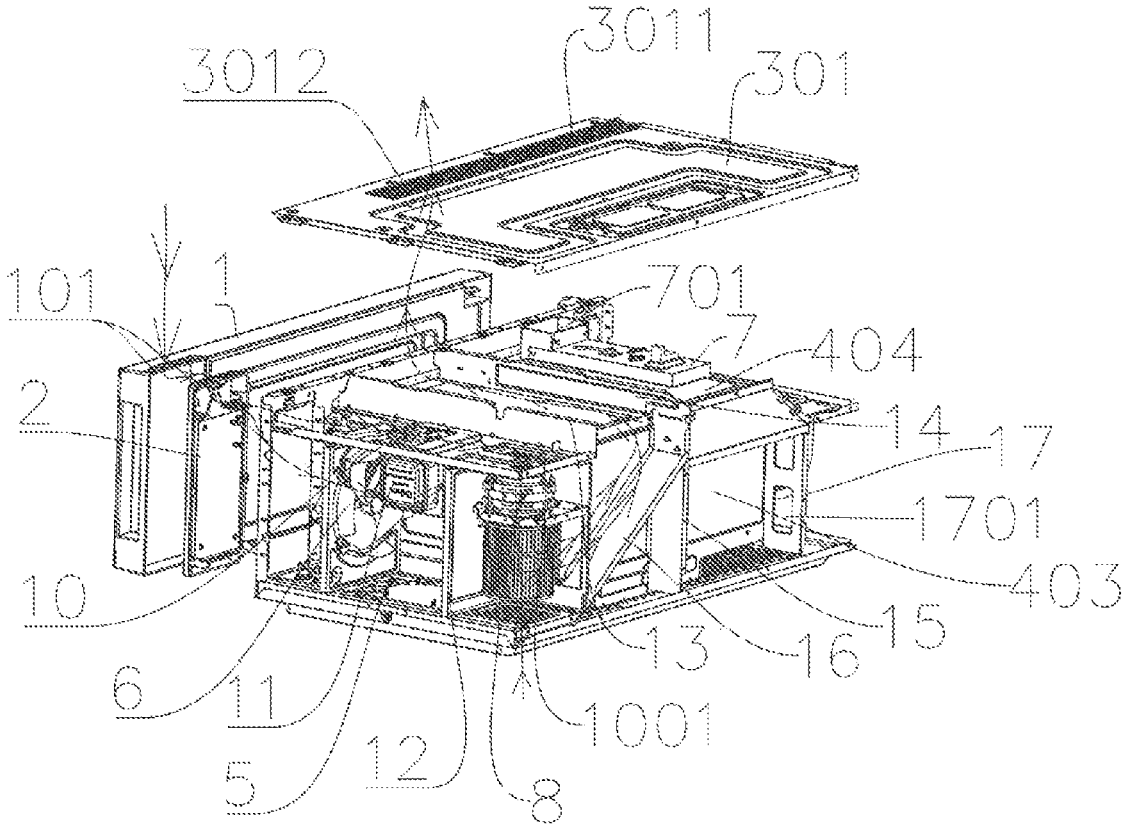
FIG. 4 is a schematic structural diagram of a housing, a door body, and a control panel case of a cooking appliance being separated from a cooking cavity from another angle.
Figure 5:
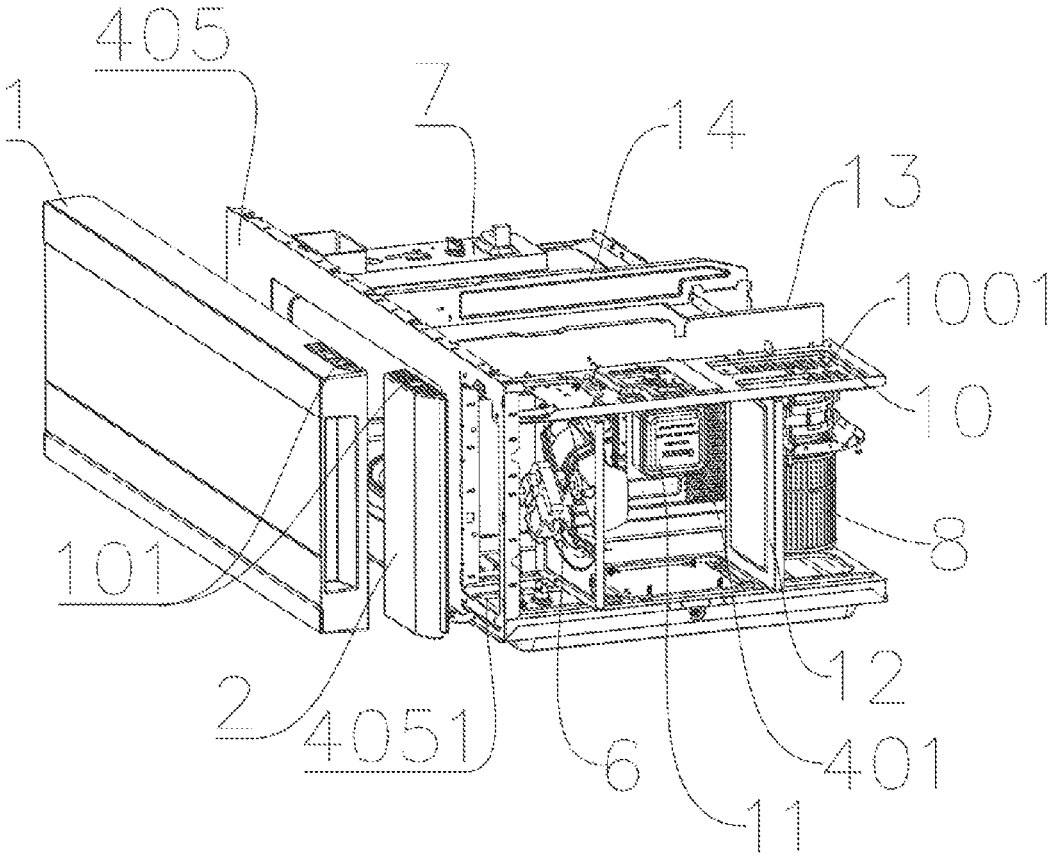
FIG. 5 is a schematic structural diagram of a door body and a control panel case of a cooking appliance being separated from a cooking cavity.

In a specific implementation, as shown in FIG. 3 to FIG. 5, the cooling air inlet 101 is provided at the top of each of the door body 1 and the control panel case 2. The cooking cavity 4 has a cavity front plate 405. An opening 4051 is provided in the cavity front plate 405. The cooling air inlet 101 is in fluid communication with the electric chamber 5 through the opening 4051. Certainly, in another alternative implementation, the cooling air inlet 101 may be provided only at the top of the door body 1 or the control panel case 2.

As shown in FIG. 1, to facilitate door opening, a door handle 102 is disposed on the right side of the door body 1.

Based on the foregoing implementations, in an optional implementation, a cavity air inlet hole 401 is provided in a cavity wall of the cooking cavity 4 adjacent to the electric chamber 5. The electric chamber 5 is in fluid communication with the cooking cavity 4 through the cavity air inlet hole 401. In this implementation, after performing heat dissipation and temperature reduction for the electric chamber 5, cooling air may enter the cooking cavity 4 through the cavity air inlet hole 401. A flow path of cooling air is relatively short, and the cooling effect is good. In another alternative implementation, the cavity air inlet hole 401 may be provided in another cavity wall of the cooking cavity 4, and the electric chamber 5 is in communication with the cavity air inlet hole 401 through an air duct or conduit.

Specifically, as shown in FIG. 5, the cavity air inlet hole 401 is a plurality of meshes.

Based on the foregoing implementations, in an optional implementation, a cavity exhaust hole 402 is provided in a top wall 404 of the cooking cavity 4, an air director 7 is disposed above the cavity exhaust hole 402, and the air director 7 is in communication with the exhaust port. In this implementation, after cooling air has cooled the interior of the cooking cavity 4 or steam generated inside the cooking cavity 4 when the cooking appliance operates flows to the exhaust port through the cavity exhaust hole 402 and the air director 7, the cooling air and steam is discharged outside the cooking appliance through the exhaust port. Through the arrangement of the air director 7, steam or air can be better guided.

As shown in FIG. 3 and FIG. 4, to keep the air pressure inside the cooking cavity 4 from becoming excessively high, the area of the cavity exhaust hole 402 is relatively large. The air director 7 covers the cavity exhaust hole 402. An air guide opening 701 is provided in the air director 7. A projection area of the air director 7 onto the cooking cavity 4 is larger than a projection area of the air guide opening 701. Steam or air first accumulates at the air director 7, and is then discharged through the air guide opening 701.

Specifically, as shown in FIG. 3, the cavity air inlet hole 402 is a plurality of meshes.

Based on the foregoing implementations, in an optional implementation, the housing 3 includes a bottom plate 302, a smoke inlet 3021 is provided in the bottom plate 302, a second fan 8 is disposed behind the electric chamber 5, a third fan 9 is disposed on the other side of the cooking cavity 4, the smoke inlet 3021 extends from a position under the second fan 8 to a position under the third fan 9, and an air outlet of the second fan 8 and an air outlet of the third fan 9 are respectively in fluid communication with the exhaust port. Conventionally, two small smoke inlets are provided in the bottom plate 302 of the housing 3. A smoke extraction range is very small, fumes between the two small smoke inlets tend to escape because smoke extraction is not in time, and the effect of smoke extraction is relatively poor. The smoke inlet 3021 in this implementation extends from the lower side of the second fan 8 to the lower side of the third fan 9, so that a smoke extraction area is increased, smoke escape is reduced, and the effect of smoke extraction can be improved. When the cooking appliance performs a fume extraction function, the second fan 8 and the third fan 9 operate, and fumes enter the second fan 8 and the third fan 9 through the smoke inlet 3021 and then respectively flows out from the air outlet of the second fan 8 and the air outlet of the third fan 9 to be discharged outside the cooking appliance through the exhaust port.

Based on the foregoing implementations, in an optional implementation, an installation board 10 is further disposed in the electric chamber 5, the installation board 10 is located above the first fan 6, a filter plate is disposed on the installation board 10, and a space above the installation board 10 is in fluid communication with the cooling air inlet 101, an air suction opening of the second fan 8 and the exhaust port. In this implementation, after entering through the cooling air inlet 101, cooling air can cool the electric chamber 5 and can perform heat dissipation and cooling for the filter plate. The cooling air after heat dissipation is eventually extracted by the second fan 8 and is mixed with fumes, which are together discharged outside the cooking appliance through the exhaust port. Because the fumes have a relatively high temperature, after the cooling air and the fumes are mixed, the fumes can be cooled to some extent, thereby reducing the temperature of the discharged fumes.

Figure 6:
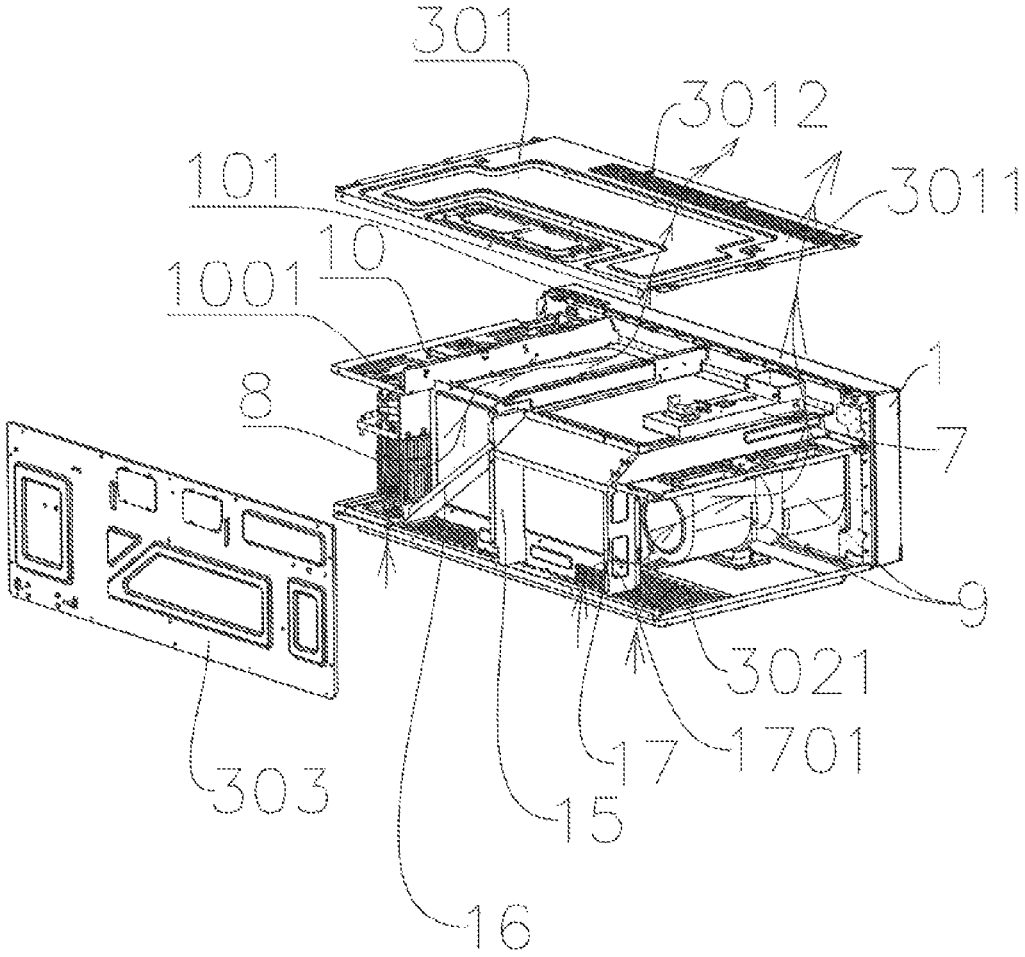
FIG. 6 is a schematic structural diagram of a top plate and a rear plate of a cooking appliance being separated from a cooking cavity.

As shown in FIG. 4 to FIG. 6, wind meshes 1001 are disposed at a position above the second fan 8 located on the installation board 10. An air inlet of the second fan 8 is located at the top thereof. After performing heat dissipation and cooling on the filter plate, cooling air enters the second fan 8 through the wind meshes 1001.

Based on the foregoing implementations, in an optional implementation, a magnetron 11 and a first partition board 12 are disposed in the electric chamber 5, the first partition board 12 is disposed between the cooking cavity 4 and the housing 3 and extends in a vertical direction, a connection between the first partition board 12 and the cooking cavity 4 is located on a side of the second fan 8 close to the cavity air inlet hole 401, and the magnetron 11 is located on an air supply path of the first fan 6. In this implementation, cooling air can perform heat dissipation and temperature reduction on the magnetron 11. The arrangement of the first partition board 12 can prevent fumes at the bottom from entering the electric chamber 5, to reduce the pollution to and high temperature impact on electronic components in the electric chamber 5 caused by fumes, thereby extending the service life of the electronic components in the electric chamber 5.

Specifically, as shown in FIG. 5, the magnetron 11 is located on an air flow path from the first fan 6 to the cavity air inlet hole 401.

Based on the foregoing implementations, in an optional implementation, the exhaust port includes a first exhaust port 3011 and a second exhaust port 3012 distributed in a left-and-right direction, a second partition board 13 and a third partition board 14 extending in a front-and-rear direction are disposed on the top wall 404 of the cooking cavity 4, the second partition board 13 is adjacent to the installation board 10, the third partition board 14 and the second partition board 13 are spaced apart, a region between the second partition board 13 and the third partition board 14 is in communication with the second exhaust port 3012, the air director 7 is located on a side of the third partition board 14 away from the second partition board 13, the first exhaust port 3011 is in communication with the air outlet of the third fan 9 and the air director 7, a fourth partition board 15 is further disposed on a rear side of the cooking cavity 4, and the fourth partition board 15 is disposed to extend in a vertical direction between the cooking cavity 4 and the housing 3 and is connected to the third partition board 14. In this implementation, a first smoke exhaust air duct is defined by the top plate 301, the rear plate 303, the second partition board 13, the third partition board 14, the fourth partition board 15, and the rear wall 403 and the top wall 404 of the cooking cavity 4. The smoke inlet 3021, the second fan 8, the first smoke exhaust air duct, and the second exhaust port 3012 are in fluid communication. One part of the fumes is sucked in by the second fan 8 through the smoke inlet 3021, flows out through the air outlet of the second fan 8 to enter the first smoke exhaust air duct, and is eventually discharged outside the cooking cavity 4 through the second exhaust port 3012. A second smoke exhaust air duct is defined by the top plate 301, the rear plate 303, the third partition board 14, the fourth partition board 15, and the rear wall 403 and the top wall 404 of the cooking cavity 4. The second smoke exhaust air duct and the first smoke exhaust air duct are distributed apart in the left-and-right direction. The smoke inlet 3021, the third fan 9, the second smoke exhaust air duct, and the first exhaust port 3011 are in fluid communication. The air director 7 is located in the second smoke exhaust air duct. Another part of the fumes enters through a smoke suction opening, is sucked in by the third fan 9, and flows out through the air outlet of the third fan 9 to be discharged outside the cooking cavity 4 through the first exhaust port 3011. Two smoke exhaust air ducts are obtained through division, and the second fan 8 and the third fan 9 operate simultaneously, so that the smoke exhaust efficiency can be improved.

Specifically, as shown in FIG. 1, FIG. 3, and FIG. 4, the first exhaust port 3011 is located on the left side of the top plate 301 and is close to the front side, the second exhaust port 3012 is located in the middle of the top plate 301 and is close to the front side, and the second exhaust port 3012 is adjacent to the first exhaust port 3011.

Based on the foregoing implementations, in an optional implementation, a fifth partition board 16 is further disposed on the rear side of the cooking cavity 4, the fifth partition board 16 is disposed obliquely, a lower end of the fifth partition board 16 is disposed adjacent to the air outlet of the second fan 8, and an upper end of the fifth partition board 16 is connected to the fourth partition board 15 and is close to the top wall 404 of the cooking cavity 4. In this implementation, the fifth partition board 16 is obliquely disposed, so that air blown by the second fan 8 directly flows to the top of the cooking cavity 4 along the fifth partition board 16, thereby reducing the length of the first smoke exhaust air duct is reduced, which can accelerate the discharge of fumes.

Based on the foregoing implementations, in an optional implementation, a sixth partition board 17 is further disposed between the cooking cavity 4 and the rear plate 303. The sixth partition board 17 extends in the vertical direction. The sixth partition board 17 is connected to a left side wall of the cooking cavity 4. A smoke opening 1701 is provided in the sixth partition board 17. Fumes between the sixth partition board 17 and the fourth partition board 15 may pass through the smoke opening 1701 to be sucked away by a third blower.

Example 2

This embodiment provides a cooking appliance.

Figure 7:
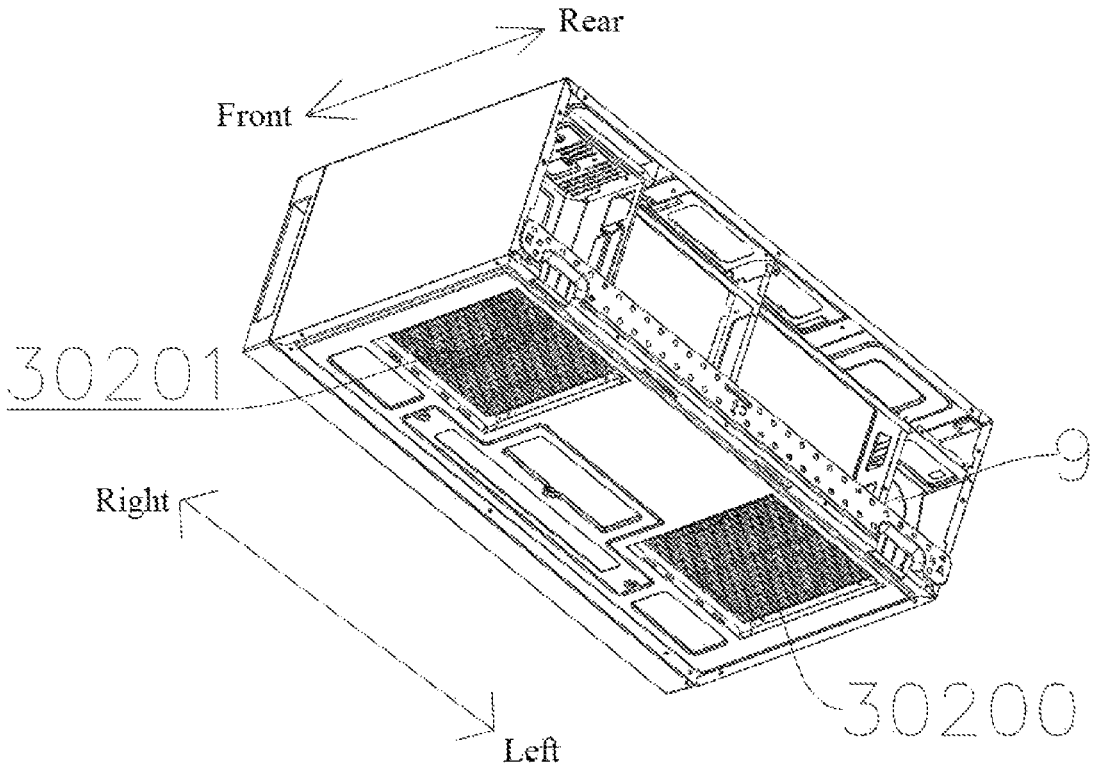
FIG. 7 is a schematic structural diagram of a cooking appliance according to Embodiment 2 of the present application.
Figure 8:
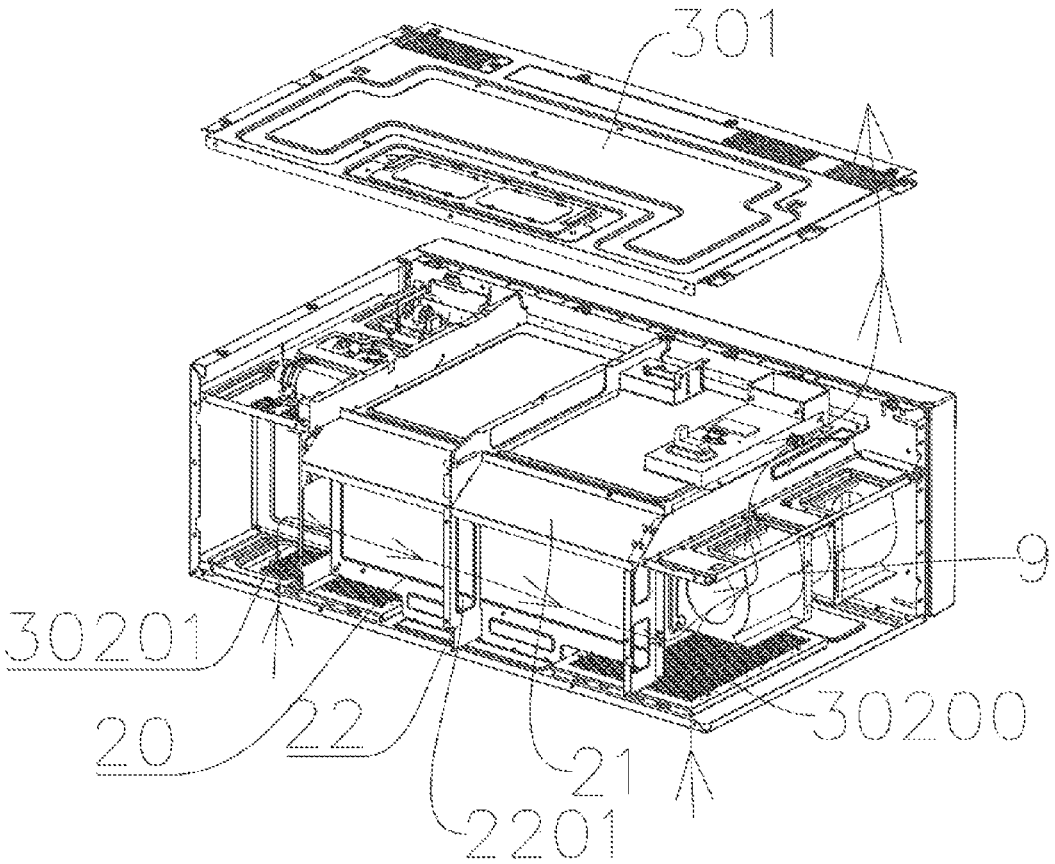
FIG. 8 is a schematic structural diagram of a top plate of a cooking appliance being separated from a cooking cavity according to Embodiment 2 of the present application.

Differences between the cooking appliance in this embodiment and the cooking appliance provided in the foregoing embodiment lie in that, as shown in FIG. 7 and FIG. 8, the housing 3 includes a bottom plate 302, a smoke inlet is provided in the bottom plate 302, a third fan 9 is further disposed between the cooking cavity 4 and the housing 3, the third fan 9 and the electric chamber 5 are respectively located on a left side and a right side of the cooking cavity 4, an air inlet of the third fan 9 is in communication with the smoke inlet, and an air outlet of the third fan 9 is provided adjacent to the exhaust port.

In this embodiment, the second fan 8 is not disposed. After entering through the smoke inlet, fumes are sucked in by the third fan 9, and flow out through the air outlet of the third fan 9 to be discharged outside the cooking appliance through the exhaust port. Because the air outlet of the third fan 9 and the exhaust port are disposed adjacently, the length of the air duct is reduced, so that the resistance on the fumes in a flowing process can be reduced, thereby improving the effect of smoke exhaust.

Specifically, the air outlet of the third fan 9 and the first exhaust port 3011 are disposed adjacently.

The smoke inlet may be the same as the smoke inlet in the foregoing embodiment, and may also include a first smoke suction opening 30200 and a second smoke suction opening 30201, the first smoke suction opening 30200 and the second smoke suction opening 30201 are respectively located on a left side and a right side of the bottom plate 302, the housing 3 includes a rear plate 303, a rear air duct 20 is formed between the rear plate 303 and the cooking cavity 4, the first smoke suction opening 30200 is adjacent to the air inlet of the third fan 9 and is in communication with the air inlet of the third fan 9, and the second smoke suction opening 30201 is in communication with the air inlet of the third fan 9 through the rear air duct 20.

Specifically, with reference to FIG. 7 and FIG. 8, the first smoke suction opening 30200 is located on the right side of the bottom plate 302, and the second smoke suction opening 30201 is located on the left side of the bottom plate 302. The cooking cavity 4 has the rear wall 403. A cover plate 21 is disposed between the top of the cooking cavity 4 and the rear plate 303. The rear air duct 20 is defined by the cover plate 21, the bottom plate 302, the rear wall 403, and the rear plate 303. To support the cover plate 21, a plurality of support partition boards 22 are disposed between the cover plate 21 and the bottom plate 302. Circulation holes 2201 for fume circulation are provided in the support partition boards 22. In this implementation, the first smoke suction opening 30200 and the second smoke suction opening 30201 are provided on the left and right sides of the bottom plate 302, so that fumes below the cooking appliance can be evenly sucked away, a smoke extraction amount is increased, and the effect of smoke extraction is improved. Only one suction blower is disposed, so that a quantity of blowers can be reduced while ensuring the effect of fume extraction, thereby reducing the cost and weight of the entire cooking appliance.

Obviously, the foregoing embodiments are merely examples for clear description, rather than a limitation to implementations. For a person of ordinary skill in the art, other changes or variations in different forms may also be made based on the foregoing description. All implementations cannot and do not need to be exhaustively listed herein. Obvious changes or variations that are derived there from still fall within the protection scope of present application.

The invention claimed is:

1. A cooking appliance, comprising:

a box body;

a door body; and a control panel case;

wherein the box body comprises a housing, a cooking cavity located in the housing, and an electric chamber located on a right side of the cooking cavity with a first partition board disposed therein, the housing comprises a top plate, an exhaust port is provided in the top plate, a first fan is disposed in the electric chamber, the door body and the control panel case are disposed on a front side of the cooking cavity, a cooling air inlet is provided in at least one of the door body and the control panel case, and the cooling air inlet, the electric chamber, the cooking cavity, and the exhaust port are in fluid communication, and wherein a cavity exhaust hole is provided in a top wall of the cooking cavity, an air director is disposed above the cavity exhaust hole, and the air director is in communication with the exhaust port, wherein an installation board is further disposed in the electric chamber, the installation board is located above the first fan, and wherein the exhaust port comprises a first exhaust port and a second exhaust port distributed in a left-and-right direction, a second partition board and a third partition board extending in a front-and-rear direction are disposed on the top wall of the cooking cavity, the second partition board is adjacent to the installation board, the third partition board and the second partition board are spaced apart, a region between the second partition board and the third partition board is in communication with the second exhaust port, a fourth partition board is further disposed on a rear side of the cooking cavity, and the fourth partition board is disposed to extend in a vertical direction between the cooking cavity and the housing and is connected to the third partition board.

2. The cooking appliance according to claim 1, wherein a cavity air inlet hole is provided in a cavity wall of the cooking cavity adjacent to the electric chamber, and the electric chamber is in fluid communication with the cooking cavity through the cavity air inlet hole.

3. The cooking appliance according to claim 1, wherein the housing comprises a bottom plate, a smoke inlet is provided in the bottom plate, a second fan is disposed behind the electric chamber, a third fan is disposed on a left side of the cooking cavity, the smoke inlet extends from a position under the second fan to a position under the third fan, and an air outlet of the second fan and an air outlet of the third fan are respectively in fluid communication with the exhaust port.

4. The cooking appliance according to claim 3, wherein a filter plate is disposed on the installation board, and a space above the installation board is in fluid communication with the cooling air inlet, an air suction opening of the second fan and the exhaust port.

5. The cooking appliance according to claim 4, wherein a magnetron and the first partition board are disposed in the electric chamber, the first partition board is disposed between the cooking cavity and the housing and extends in a vertical direction, a connection between the first partition board and the cooking cavity is located on a side of the second fan close to the cavity air inlet hole, and the magnetron is located on an air supply path of the first fan.

6. The cooking appliance according to claim 4, wherein the first exhaust port is in communication with the air outlet of the third fan and the air director.

7. The cooking appliance according to claim 6, wherein a fifth partition board is further disposed on the rear side of the cooking cavity, the fifth partition board is disposed obliquely, a lower end of the fifth partition board is disposed adjacent to the air outlet of the second fan, and an upper end of the fifth partition board is connected to the fourth partition board and is close to the top wall of the cooking cavity.

8. The cooking appliance according to claim 1, wherein the housing comprises a bottom plate, a smoke inlet is provided in the bottom plate, a third fan is further disposed between the cooking cavity and the housing, the third fan and the electric chamber are respectively located on a left side and the right side of the cooking cavity, an air inlet of the third fan is in communication with the smoke inlet, and an air outlet of the third fan is provided adjacent to the exhaust port.

9. The cooking appliance according to claim 8, wherein the smoke inlet comprises a first smoke suction opening and a second smoke suction opening, the first smoke suction opening and the second smoke suction opening are respectively located on a left side and a right side of the bottom plate, the housing comprises a rear plate, a rear air duct is formed between the rear plate and the cooking cavity, the first smoke suction opening is adjacent to the air inlet of the third fan and is in communication with the air inlet of the third fan, and the second smoke suction opening is in communication with the air inlet of the third fan through the rear air duct.

* * * * *